United States Patent [19]

Weatherford et al.

[11] 4,206,920

[45] Jun. 10, 1980

[54] MULTIPLE DIGIT ELECTRONIC GAME

[76] Inventors: Fred Weatherford, 5317 Chesapeake Rd., Hyattsville, Md. 20781; Karl D. Toll, 6315 Riverdale Rd., Riverdale, Md. 20840

[21] Appl. No.: 848,594

[22] Filed: Nov. 4, 1977

[51] Int. Cl.[2] ..... A63F 9/00

[52] U.S. Cl. ..... 273/138 A

[58] Field of Search ..... 273/138 A, 139, 143 R, 273/1 E, 237

[56] References Cited

U.S. PATENT DOCUMENTS

| | | | |
|---|---|---|---|
| 3,269,503 | 8/1966 | Foster | 273/138 A X |
| 3,606,337 | 9/1971 | Larsen et al. | 273/143 R |
| 3,770,269 | 11/1973 | Elder | 273/138 A |
| 3,825,255 | 7/1974 | Kennard | 273/139 X |
| 3,876,208 | 4/1975 | Wachtler et al. | 273/138 A |
| 3,889,956 | 6/1975 | Castle | 273/138 A |
| 3,929,338 | 12/1975 | Busch | 273/138A |

*Primary Examiner*—Vance Y. Hum

*Attorney, Agent, or Firm*—Harold Gell

[57] ABSTRACT

An electronic game adapted to permit a player to select a sequence of digits in anticipation of a sequence of digits selected by a random number generator is provided with a programmable comparator which the player may direct to provide a WIN indication logic output in the event of a perfect, sequential match between the player selected digits and the randomly selected digits or, a match between the player selected digits and the randomly selected digits irrespective of sequence.

3 Claims, 12 Drawing Figures

TO 1043 PIN 9
TO 1043 PIN11
TO 1043 PIN14
110
7411A
107
7420A
A1
A2
A3
A4
108
7420B
B1
B2
B3
B4
109
7420A
C1
C2
C3
C4
111
7402A
112
7402B
113
7402C
Vcc
7432
119
117
116
114
115
TO 1164
TO 1163
TO 808 PIN 9
TO 816 PIN12
101
102
7474
Q
PR
Q̄
200Ω
LED 118
LED 120
7400
103
7404
104
105
106
D
E
JOINS FIG.2
JOINS FIG.4

JOINS FIG.4
2N1301
Vcc
515
100K
680
100K
.68uf
517
.1
518
.68
516
514
3.3K
1K
7404
519
7404
520
IN60
100K
1K
513
7404
512
30MFD
3.3K
1K
507
7400
A
506
7473B
522
7404
508
7400
B
521
7404
509
7400
C
7473A
511
7404
510
7400
D
JOINS FIG. 6
505
CK
Vcc
1K
.001
Vcc
501
CL
Q
7474
PR
.2MfD
502
100K
7ufD
503
1K
504
7404
.001
JOINS FIG.7

JOINS FIG. 9
JOINS FIG. 11
T1
T2
T3
7410
7411
7474
7442
7485
7404
1001
1010
1011
1020
1021
1030
1031
1040
1041
1042
1043
1050
1051
1052
1053
1054
1055
PR
CLR
Q
Vcc
2K
.1ufD
from 107
from 108
from 109

MULTIPLE DIGIT ELECTRONIC GAME

This patent is directed to an electronic game wherein a player arbitrarily selects a sequence of digits in anticipation of a sequence of digits selected by an electronic random number generator.

BACKGROUND OF THE INVENTION

Contemporary man has devised numerous forms of entertainment based on attempting to anticipate numbers generated by a relatively uncontrollable source. Games such as these have been popular throughout history but in contemporary times one example that has earned significant notoriety is known as the numbers game where a player selects a plurality of digits in anticipation of a sequence of numbers which are selected by an uncontrollable source and will be published in a newspaper at a future date. This particular form of guessing game creates significant competition among the players and has been used in the past for illegal wagering in many areas.

In view of the increasing costs of administering state supported programs, many states have turned the Lotterys to raise additional funds to bolster their monetary reserves heretofore primarily supported by taxes. Many of these legal, state supported Lotterys are based on a numbers game concept wherein the players select a sequence of numbers in anticipation of a sequence of numbers to be derived by some random number generating means.

The numerous versions of number anticipation games presently used lack appeal, and thus utility in that the player must wait an unduly long period of time for the random numbers which he is attempting to anticipate to be produced and must also wait an unacceptable period of time for his reward if he has been successful in anticipating the winning number.

OBJECTIVES OF THE INVENTION

Therefore, a primary objective of the present invention is to provide a random number anticipation game in which the player or players are provided with the random number they are attempting to anticipate immediately after making their selection.

A further objective of the present invention is to provide an electronic game wherein a player may select a sequence of three digits in anticipation of an electronically generated random number comprised of three digits.

A still further objective of the present invention is to provide an electronic random number anticipation game in which the player selected number and the randomly generated numer are electronically compared to provide a winning indication when an exact, sequential match is achieved.

A still further objective of the present invention is to provide an electronic random number anticipation game wherein the player selected number is electronically compared with the randomly generated number and a WIN indication is provided when a predetermined number of numerical matches occur regardless of sequence.

Another objective of the present invention is to provide a number guessing game wherein a winning indication on an electronic display panel is maintained until the game device is reset by a manually operated security means.

A still further objective of the present invention is to provide a random number anticipation game wherein an electrically created display of a winning selection is maintained in the event of a primary power loss by a secondary power supply.

A still further objective of the present invention is to provide an electronic random number anticipation game wherein the ability to select the anticipating numbers by a player is inhibited as soon as the complete sequence has been selected and will remain inhibited until the system is manually reset.

A still further objective of the present invention is to provide an electronic random number anticipation game which is fail-safe, lightweight and relatively inexpensive to produce.

An even further objective of the present invention is to provide a random number anticipation game which includes a check control means adapted to be activated by the insertion of a check.

A further objective of the present invention is to provide an electronic random number anticipation game wherein a predetermined number of checks are automatically dispensed to the player in the event of his successful anticipation of the randomly generated number.

It is a further objective of this invention to provide a game apparatus which is composed predominantly of electronic circuitry, whereby the listed disadvantages of the prior art are eliminated.

Another objective of the invention is to provide a game apparatus which is highly compact, lightweight, inexpensive to manufacture, and positive in operation.

A further objective of the invention is to provide a gaming apparatus that will:

(1) dispense coins when the player has won (2) provide an audible indication when the numbers are inserted into the machine and when the machine is operating (3) provide an alarm mechanism which will give off a loud noise when the apparatus is tilted, or raised.

A still further objective of the invention is to provide a game apparatus with a display device whereby various numbers are exhibited in a clearly distinguishable manner.

SUMMARY OF THE INVENTION

The present invention accomplishes the foregoing objectives and those objectives which will become apparent to the reader of this specification, through the use of an electronic device which may be energized by a player via a switch means which may be responsive to a check. Once energized, the device provides a means whereby a player may arbitrarily select a predetermined number of digits in a predetermined sequence. The selected digits are displayed in a readout means and a pulse code representation of the digits is forwarded to a comparator.

Upon selection of the sequence of digits, the switch means for selecting the digits is inhibited and a random number generator is activated. The random number generator selects a sequence of digits which are applied to the comparator which generates a WIN signal as a function of the specific type of comparison selected by the player. The WIN signal is adapted to energize a WIN light, provide a numerical readout based on the probability of the specific WIN indicated and in a preferred embodiment provide an automatic delivery to the player of machine activating checks to facilitate the players scorekeeping processes.

DESCRIPTION OF THE INVENTION

Figure 12:
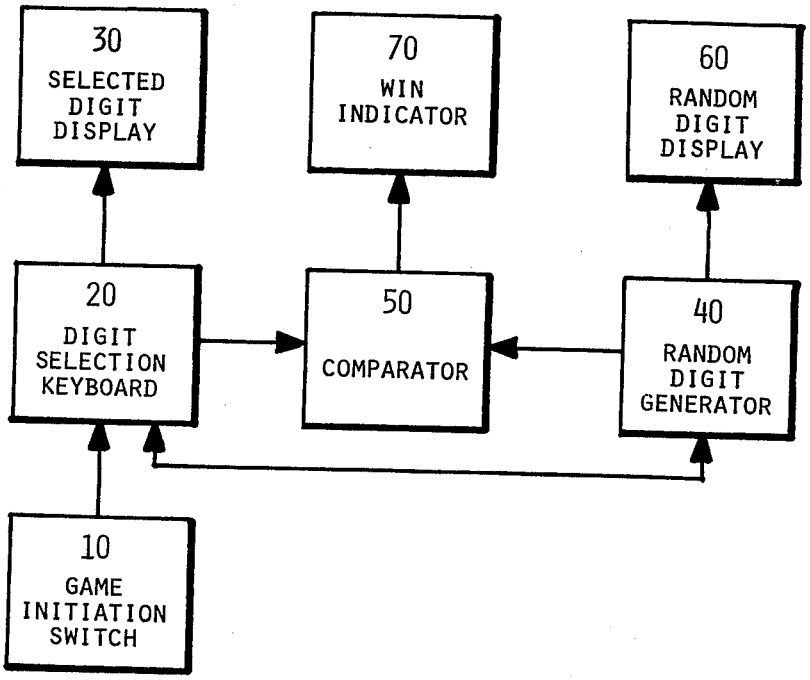
FIG. 12 is a simplified diagram of the electronic game presented herein.

FIG. 12 illustrates the basic subsystems of the game apparatus presented by this patent. The game is played by activation of a switch 10 which, in a preferred embodiment, is accomplished by insertion of a check into a responsive receptacle. The switch enables the digital selection keyboard 20 so that a player may select the mode of the game desired and also select one or more digits in anticipation of the operation of the random digit generator 40.

Operation of the digit selection keyboard enables the randome digit generator 40, provides an input to the selected digit display 30, and provides a logic input to comparator 50.

When the random digit generator 40 is activated, it inhibits the digit selection keyboard 20 and provides energizing signals to the random digit display 60 and logic signals to comparator 50.

The comparator 50 provides a WIN or LOSE signal to win indicator 70 which is a function of the comparison between the selected digits and the output of the random digit generator. In one embodiment of the present invention, the win indicator includes a means to return checks to the player as a function of the type of comparison which was accomplished.

In a preferred embodiment, the selected digit display 30 consists of three light emitting diode digit displays and the digit selection keyboard 20 is a push-button module. When a player inserts a check in game initiation switch 10, it resets flipflop 101 or 102 of FIG. 1 providing it is the first check inserted in a series which may consist of one check only. The outputs of flipflops 101 and 102 are high and connected to the inputs to NAND gate 103 which produces a low output. The low output of NAND gate 103 is connected to two inverters, 104 and 105.

Figure 3:
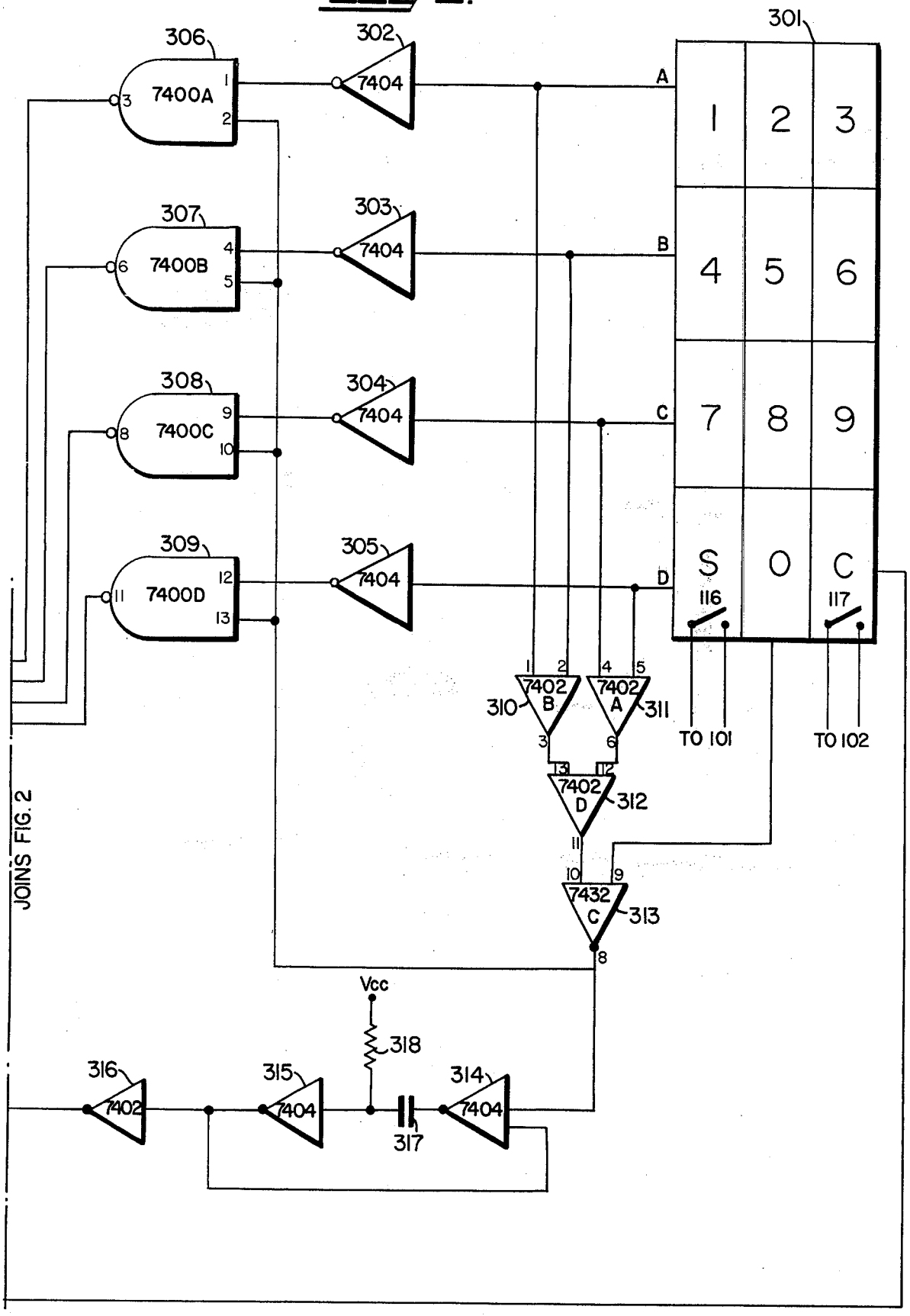

Inverter 105 is connected to push-button module 301 of FIG. 3. Flipflops 101 and 102 must be reset or the output of inverter 105 will inhibit push-button module 301.

Figure 2:
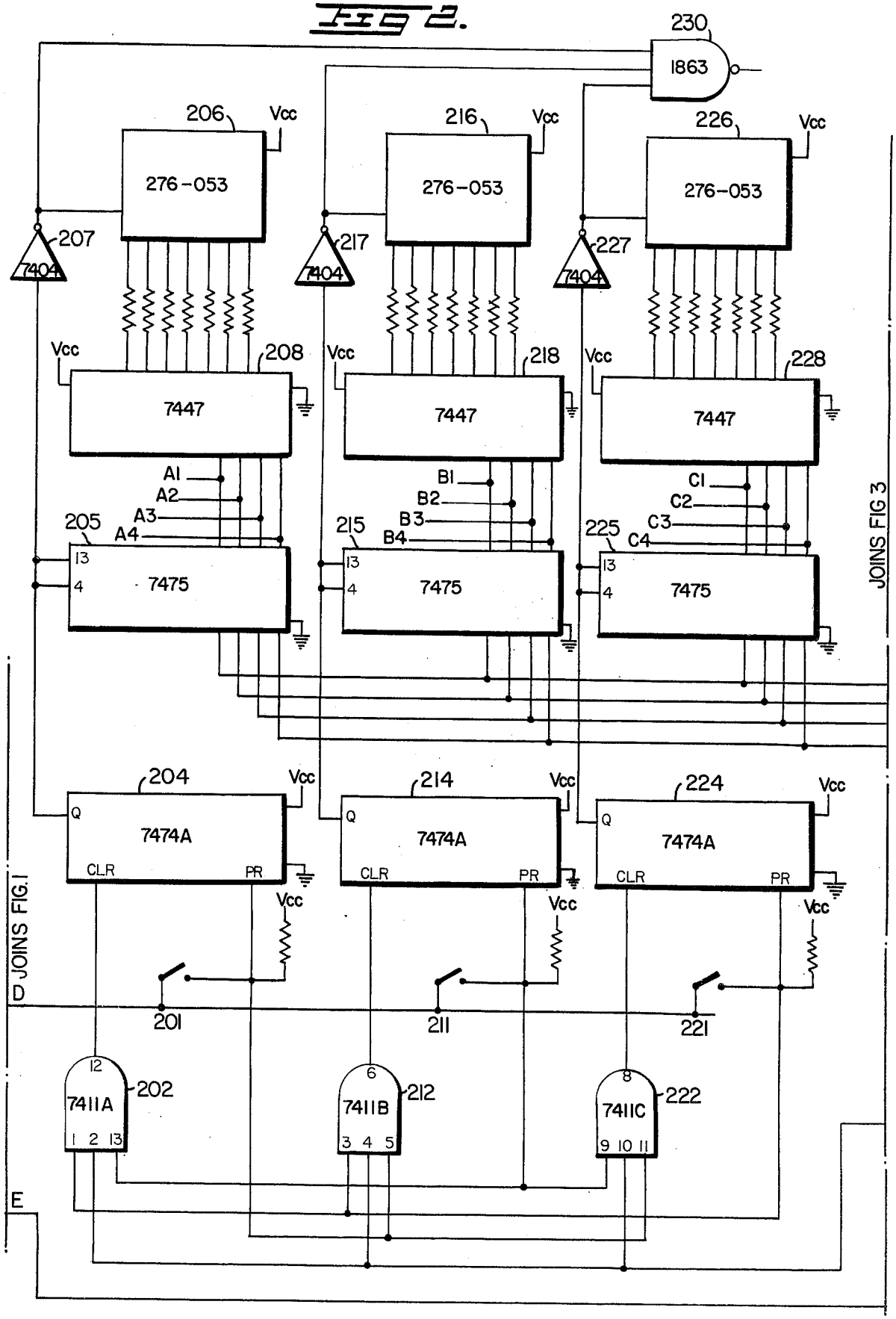

The output of inverter 105 is also connected to inverter 106 which enables or disables switches 201, 211 and 221 of FIG. 2.

Figure 6:
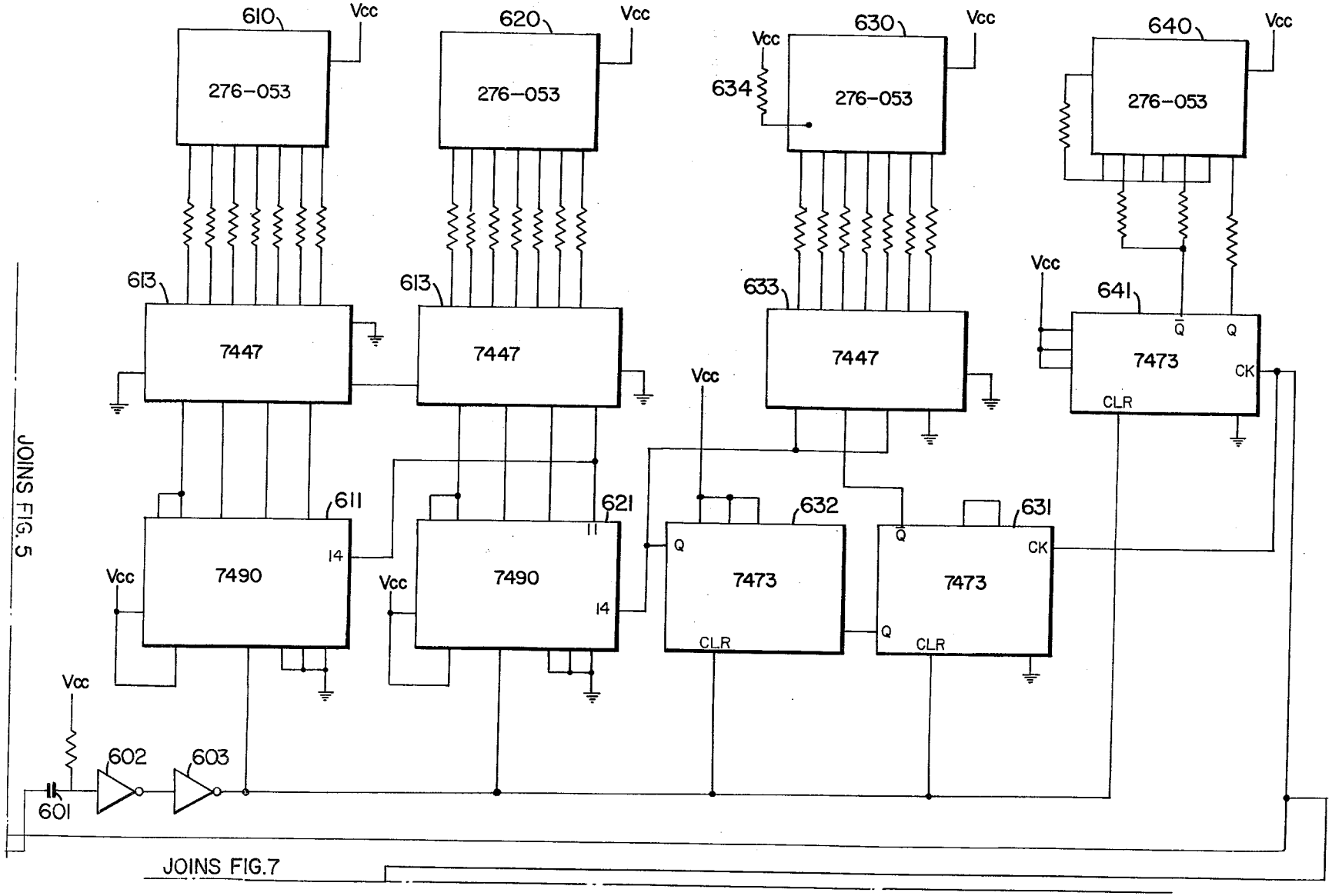

NAND gate 103 also provides an input to the coin counter circuitry of FIG. 6 via capacitor 601 where it provides a reset function.

When flipflops 101 and 102 have been reset, the push-button module 301 is enabled by an output of inverter 105 and switches 201, 211 and 221 are enabled by an output of inverter 106. This enables the circuitry in a manner that will permit a player to insert his number selections into the registers via the keyboard 301 and switches 201, 211 and 221. An operator enters the first digit by depressing switch 201 which sets flipflop 204 to provide an enabling output to counter 205. The set output of flipflop 204 also turns on the decimal point of light emitting diode 206 via inverter 207.

A player may now press any button on push-button module 301. For instance, assuming a player chooses number 8, he depresses the number 8 push-button on panel 301 and a binary 8 is coupled from the push-button module 301 via inverters 302 through 305 and NAND gates 306 through 309. The four digit binary code is applied to the three digit display counters 205, 215 and 225 but in this instance the only counter enabled is counter 205 and thus that binary signal is coupled via BCD decoder 208 to light emitting diode 206.

The NAND gates 306, 307, 308, and 309, which couple the binary code to the display counter decoders 205, 215 and 225, are enabled by a high from a five input OR gate formed from four two input OR gates 310, 311, 312, and 313. A high output from OR gate 313 enables NAND gates 306, 307, 308 and 309 and a time delay circuit comprised of amplifier 314 and inverters 315 and 316.

The output of inverter 316 is applied to one input of AND gates 202, 212 and 222. This causes AND gate 202 to conduct because of the coincidence of a high on the other two inputs of the gate. This resets flipflop 202 and disables counter 205 and extinguishes the decimal point of indicator 206. When the decimal point of indicator 206 is extinguished, the selected 8 is displayed in the LED as a function of counter 205's input to the BCD 7 segment decoder 208.

After the selection of the first digit which is displayed in LED 206, the second digit may be selected by depressing switch 211 which sets flipflop 214 and thus enables counter 215 and causes a decimal point to be displayed in light emitting diode indicator 216 via inverter 217 in a manner similar to that discussed for indicator 206. A selection of a digit at push-button panel 301 causes a four input code to be applied to counter 215 and coupled to light emitting diode indicator 216 via the BCD 7 segment decoder 218 when an output is produced by OR gate 313 and applied to AND gate 212 via the time delay circuit of amplifier 314 and inverters 315 and 316. With AND gate 212 trued, flipflop 214 is reset and the decimal point on light emitting diode indicator 216 is extinguished and the selected digit displayed.

The third digit is then selected by depressing enabling switch 221 which sets flipflop 224 and enables counter 225 and creates a decimal point to be displayed in indicator 226 via inverter 227. The binary code representing the selected digit at panel 301 is then coupled to counter 225 in a manner similar to the actions which occurred when the previous two digits were selected. However, at this time counter 225 is enabled and the data is stored. Once the number has been selected and OR gate 213 trued, the time delayed output of OR gate 313 trues AND gate 222 which resets flipflop 224 to disable counter 225 and extinguish the decimal point of indicator 226. When counter 225 is disabled, the binary coded decimal information is coupled via decoder 228 to indicator 226.

The time delay circuit comprises of amplifier 314 and inverters 315 and 316 is provided to ensure that the registers in counters 205, 215, and 225 are completely loaded with the binary coded digital signal when they are enabled. The time delay is created as a function of the charging of capacitor 317 through resistor 318 when amplifier 314's output goes low as the result of an input from OR gate 313. The output of inverter 316 is low during the time capacitor 317 is charging and the output of inverter 315 is high. The high output of inverter 315 is coupled back into amplifier 314 but when capacitor 317 is charged, the input to inverter 315 rises and causes the output to approach a binary 0. This sequence of operation generates a 10 microsecond wide pulse which is coupled via inverter 316 to an input of AND gates 202, 212, and 222.

If a player chooses to play one number only, he can accomplish this goal by pressing switch 201 which causes the output of flipflop 204 to go low. A binary 1 or high is being outputed by the selected NAND gates 306, 307, 308 and 309 as a function of the digit selected at panel 301. The binary coded digital signal which is the output of the four NAND gates is applied to counters 205, 215, and 225 but only the registers in 205 are enabled so the data can be decoded by decoder 208 and applied to indicator 206 as previously discussed. The player now depresses switch 211 without depressing a digit selection push-button on panel 301. This causes flipflop 214 to set and flipflop 204 to reset through gate 202, extinguishing the decimal point of indicator 206. This enables counter 215 and the decimal point for indicator 216 is turned on. Switch 221 is then depressed to set flipflop 224 and enable counter 225 and the decimal point of indicator 226. This action resets flipflop 214 through AND gate 212 and counter 215 is disabled. Since no number was selected at panel 301 prior to disabling counter 215, indicator 216 will remain blank and the decimal point is removed.

In this point in the sequence, all three light emitting diodes 206, 216 and 226 are blank and a decimal point is on in indicator 226. A digit may now be entered in indicator 226 via selection panel 301 as previously discussed. Alternately, if a digit is desired to be placed in indicator 206 or 216, the associated selection switch 201 or 211 for that indicator may be depressed to disable the indicator circuitry for indicator 226 and enable the desired indicator.

The A, B, and C outputs 1, 2, 3 and 4 of counter registers 205, 215, and 225 are applied to the four input NAND gates 107, 108, and 109 respectively. The outputs of NAND gates 107, 108, and 109 are coupled to AND gate 110 which produces a high when the three indicators 206, 216 and 226 are blank. A high at the output of AND gate 110 is applied to an input to amplifiers 114 and 115 to disable selection switches 116 and 117 respectively. Thus if a player accidently depresses a straight (s of switch panel 301) or combination (C of switch panel 301) when light emitting diodes 206, 216 or 226 are blank it will not activate the machine. When a digit or digits are displayed by the light emitting diodes 206, 216, or 226 in any combination, the output of AND gate 110 is low and amplifiers 114 and 115 which functions as OR gates are enabled. If a person is only playing one or two digits, the output of the OR gate formed from amplifiers 111, 112 and 113 which function as two input OR gates is high. This high output of amplifier 113 disables switch 117 because a high output to switch 117 will not allow flipflop 102 to be set.

Switch 116 is enabled by a low output from flipflop 102. When switch 116 is depressed, flipflop 101 is set by the low applied through amplifier 114 which is functioning as an OR gate. This causes the $\overline{Q}$ to go low and light emitting diode 118 is illuminated. Light emitting diode 118 is located under the S button of selector panel 301.

If a player has chosen to play three numbers in combination, all inputs to amplifiers 111 and 112 are low and coupled to amplifier 119 via the OR gate output of amplifier 113. A low is also coupled into the other input of amplifier 119 from the Q output of flipflop 101. Thus, if switch 117 is depressed flipflop 102 will be set via amplifier 115. Setting flipflop 102 causes the $\overline{Q}$ to go low which causes light emitting diode 120 to illuminate.

When flipflop 101 or 102 has been set, its $\overline{Q}$ output is low. This causes NAND gate 103 to produce a high output which is coupled to inverters 104 and 105. The output of inverters 104 and 105 is low in response to the high input and the low output of inverter 104 sets the mode control flipflop 501 of FIG. 5 via capacitor 502 which starts the random digit circuitry.

In a preferred embodiment, selector switch 301 is a modified Greyhill type 82 series push-button module. The push-button module is modified so that when the "0" button is depressed, the output is a binary 0 on the BCD line to inverters 302, 303, 304, and 305 but a binary 1 to amplifier 313.

Figure 1:
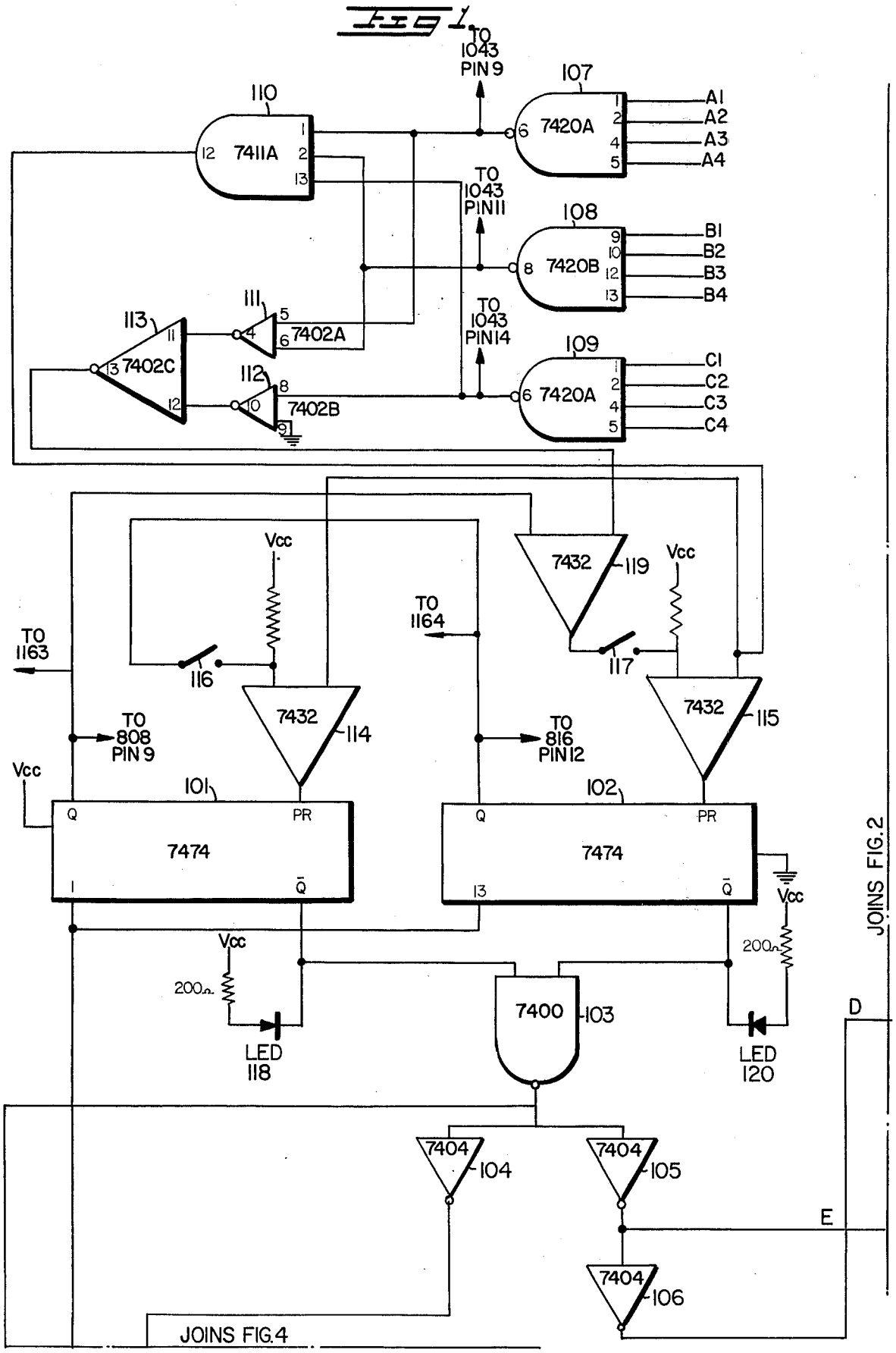
FIGS. 1 through 11 form a composite schematic logic diagram of the circuitry incorporated by the present invention. The figures should be interconnected as indicated along appropriate margins.
Figure 4:
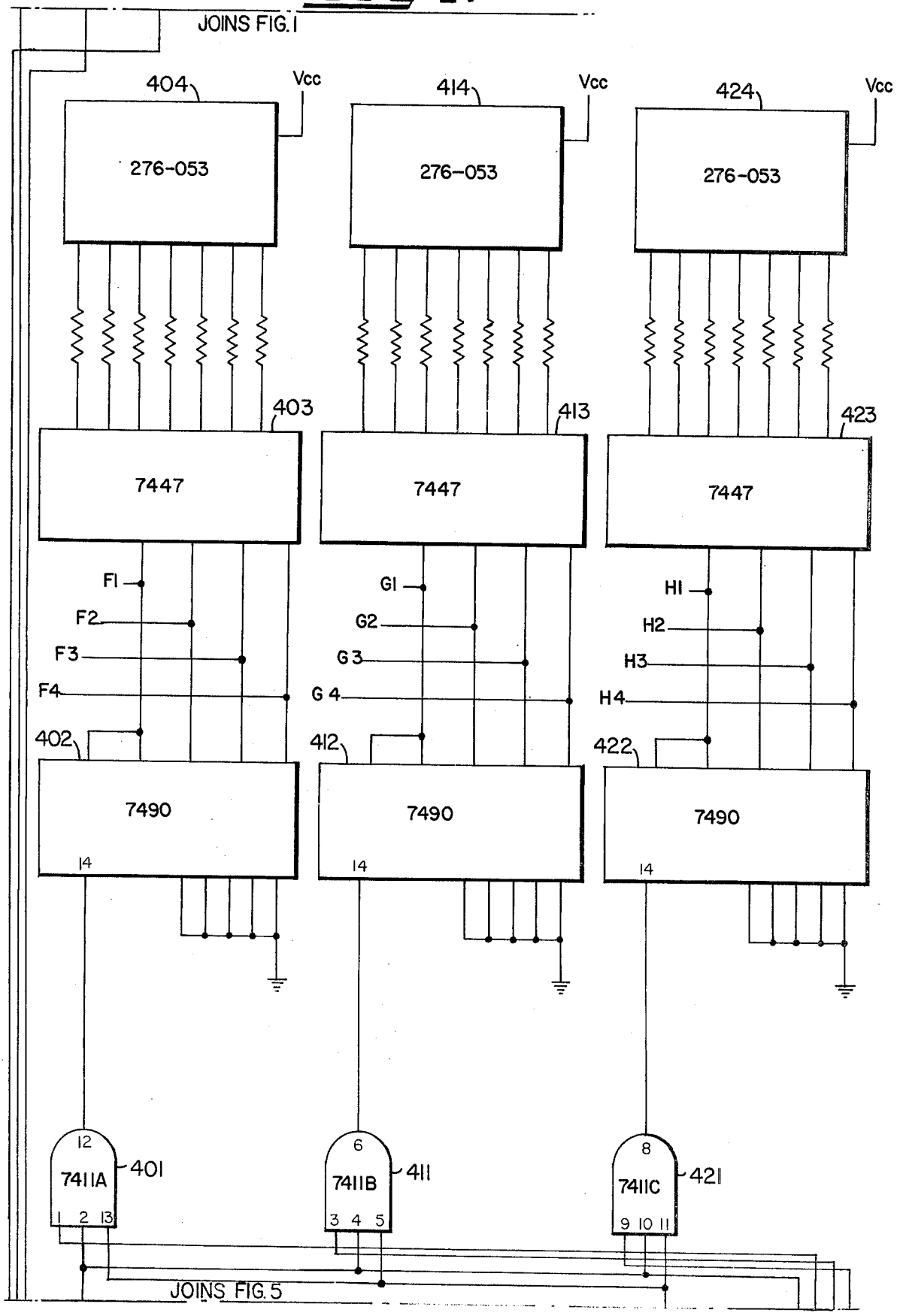
Figure 5:
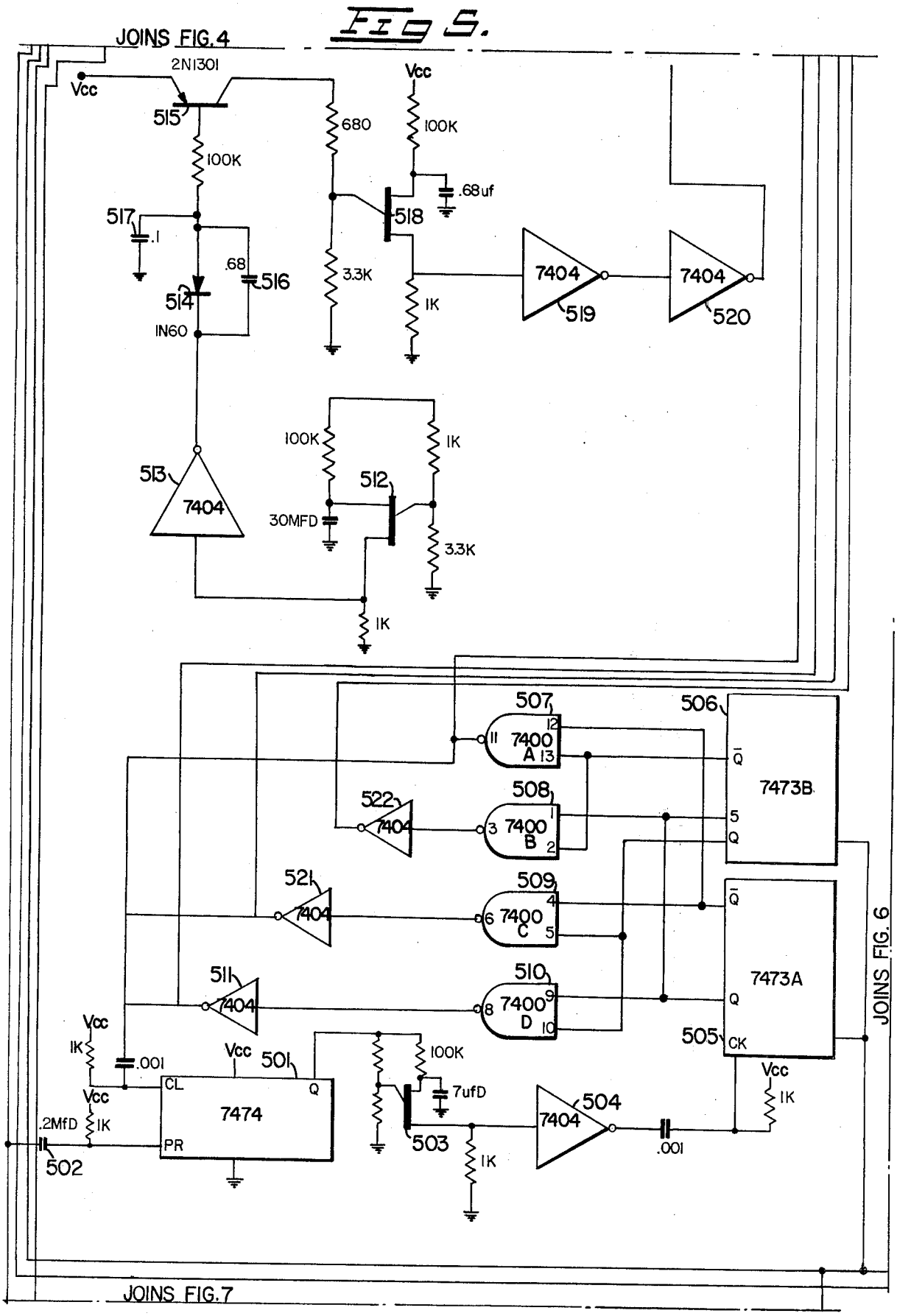

The low from inverter 104 of FIG. 1 sets flipflop 501 of FIG. 5 and starts the random digit generator. When flipflop 501 is set, the $\overline{Q}$ output goes high and applies a voltage to the unijunction transistor 503 which functions as an oscillator having a frequency of approximately 0.6 pulses per second as a function of the resistive and capacitive elements associated with transistor 503. The output of transistor 503 is applied to inverter 504 as a clock pulse train. The output of inverter 504 is applied to mode counter flipflop 505 which, in combination with mode counter flipflop 506 forms the mode control counter through the application of their set and reset outputs to NAND gates 507, 508, 509 and 510. Each time transistor 503 generates a pulse, flipflops 505 and 506 change state and when the resultant inputs to any of the four NAND gates 507 through 510 are high, that particular NAND gate output goes low. Flipflops 505 and 506 are reset whenever switch 701 is closed, which is accomplished in a preferred embodiment by the insertion of coins into a coin responsive switch means. Under these conditions, both inputs to NAND gate 507 are high and its output is low. This output is used to disable or inhibit AND gates 401, 411, and 421 of FIG. 4.

After insertion of a coin and closure of switch 701 to inhibit AND gates 401, 411 and 421, the first pulse from transistor oscillator 503 via inverter 504 to flipflops 505 and 506 causes the flipflops to change state and both inputs to NAND gate 510 are high. This creates a low output for NAND 510 which is inverted by inverter 511 and applied to AND gate 401.

Two additional clocks are used to generate random digits. The first additional clock is comprised of a unijunction transistor oscillator which produces pulses at the rate of approximately 0.7 pulses per second. It is comprised of unijunction transistor 512 and an RC network coupled to inverter 513. The output of inverter 513 is applied through a diode 514 and an RC network to the base of transistor 515. The pulses created by oscillator 512 and applied to the base of transistor 515 cause transistor 515 to conduct. Capacitors 516 and 517 begin charging, and when charged turn off transistor 515. However, the pulses which are generated by transistor 512 function to discharge the capacitors and thus turn transistor 515 back on.

The output of transistor 515 is applied to the second clock which is a unijunction transistor oscillator having a frequency of about 10 pulses per second and comprised of transistor 518 and the associated RC network. Variations in the output of transistor 515 as caused by oscillator 512 and the function of the capacitors in the base circuit of transistor 515 cause oscillator 513 to generate pulses at a rate of between 4 to 23 pulses per second. Both clocks 512 and 513 are continually operating and the resultant, varying repetition rate pulses are applied through amplifiers 519 and 520 to AND gates 401, 411, and 421. Thus when the mode control counter changes state, the output of NAND gate 507 enables AND gates 401, 411 and 421. When flipflops 505 and 506 changed state initially, NAND gate 510 was trued and a pulse was applied through inverter 511 to the second enabling input of AND gate 401. Thus everytime a clock pulse is applied to the clock input of AND gate 401, it is coupled to decade counter 402. Decade counter 402 continues counting pulses as long as AND 401 is enabled by the output from NAND gate 507 and inverter 511. The output of decade counter 402 is a binary coded decimal which is connected to the BCD 7 segment decoder 403. The outputs of decoder 403 are applied to light emitting diode indicator 404 via a plurality of resistors such that the light emitting diode constantly flashes the random generated numbers.

When oscillator 503 generates another pulse, flipflop 505 changes state and NAND gate 510 produces a high output which is inverted by inverter 511. This disables counter 402. Decoder 403 will retain the last count received from counter 402 and it will be displayed by light emitting diode indicator 404.

When the output of NAND gate 510 went high, NAND gate 509 produced a low output which is coupled via inverter 521 to AND gate 411. With AND gate 411 enabled by the output of inverter 521 and NAND gate 507, clock pulses from inverter 520 are gated to counter 412. The BCD output of counter 412 is applied to BCD decoder 413 and to light emitting diode 414 in a manner similar to that described for counter 402, decoder 403 and light emitting diode indicator 404.

When the next pulse is generated by oscillator 503, flipflops 505 and 506 change state and the output of NAND gate 509 goes high to cause inverter 521 to apply a low to AND gate 411 to disable that digit and freeze the display.

When NAND gate 509 goes high, NAND gate 508 is caused to produce a low output which is inverted by inverter 522 and applied to AND gate 421. Thus AND gate 421 is enabled by an output from inverter 522 and NAND gate 507 so that clock pulses from inverter 520 will be coupled to decade counter 422. The BCD output of decade counter 422 is applied to BCD decoder 423 and to light emitting diode indicator 424 in a manner similar to that described for counter 402, decoder 403 and light emitting diode indicator 404.

The next pulse generated by oscillator 503 causes flipflops 505 and 506 to change state and the input to NAND gate 507 goes high. This causes a low output and all gates are disabled by the removal of the enabling pulse previously applied. This also resets flipflop 501 and its $\overline{Q}$ output goes low, turning off oscillator 503. The random digits displayed by light emitting diodes 404, 414 and 424 will remain displayed until the system is reset and the next play begins.

Figure 8:
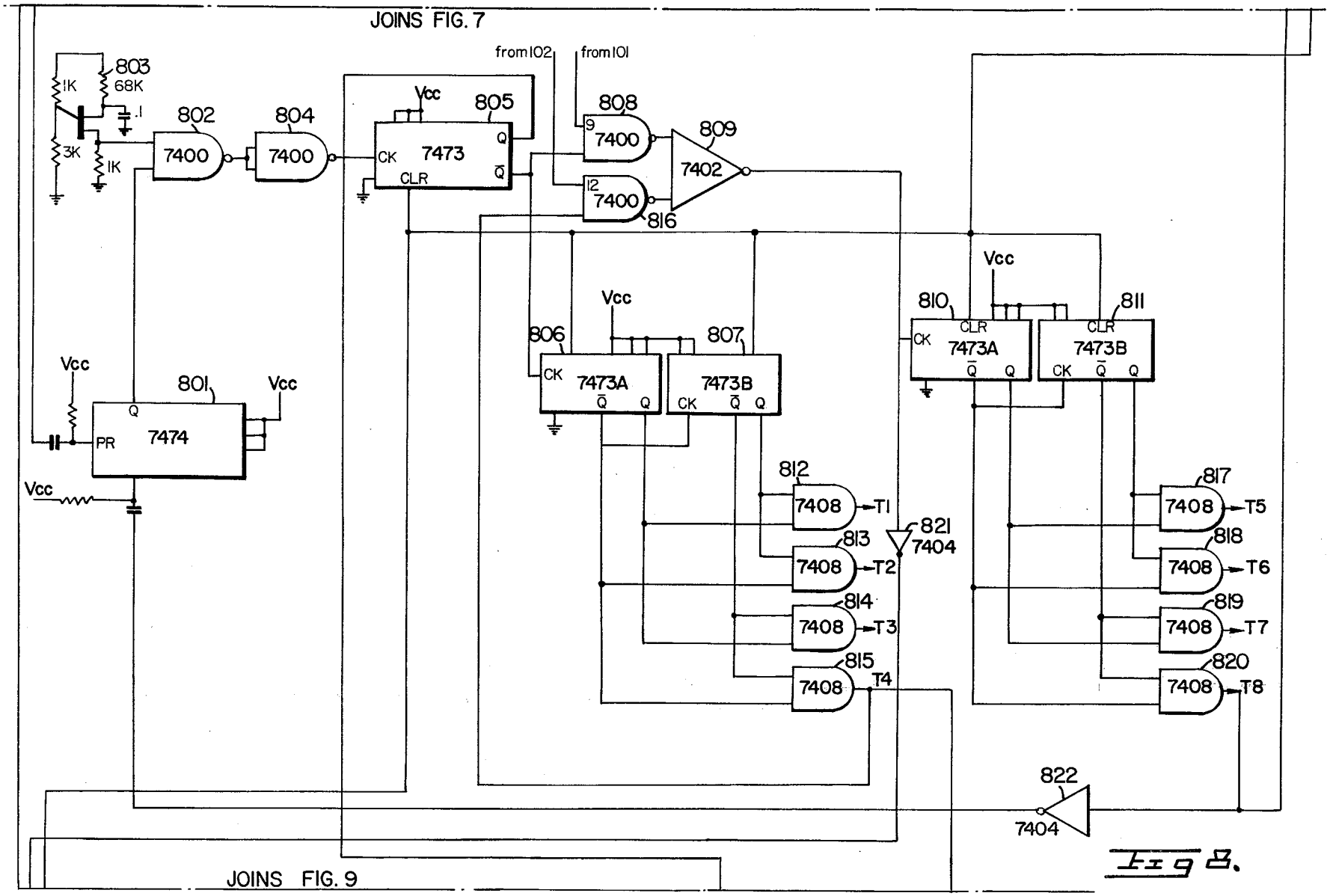

The output of NAND gate 507 is also applied to the start compare flipflop 801 of FIG. 8 which starts the compare logic.

The output of flipflop 808 is applied to NAND gate 802 which is also responsive to transistor 803 which functions as a unijunction oscillator with the associated RC network adapted to cause the oscillator to generate approximately 1,000 pulses per second. These pulses are applied to one input of NAND gate 802 which is controlled, as previously stated by the start compare flipflop 801 that is set by a low output from NAND gate 507. Thus each time a pulse appears at pin 1 of NAND gate 802, its output goes low. NAND gate 804 inverts the low output of NAND gate 802 and applies the high to flipflop 805 which functions as a two phase clock, producing a first phase at the $\overline{Q}$ output and a second phase at the Q output. The phase 1 output of flipflop 805 is applied to the clock steering circuitry and the phase 2 output is utilized to enable AND gate 1001 of FIG. 10.

The phase 1 output from flipflop 805 is applied to the A counter comprised of flipflops 806 and 807 and to NAND gate 808. If the other input to NAND gate 808, from flipflop 101, is high, the phase 1 pulses from flipflop 805 are gated through inverter 809 to the B counter comprised of flipflops 810 and 811.

The A counter comprised of flipflops 806 and 807 is a divide by four counter with outputs connected to four AND gates 812, 813, 814, and 815. Initially AND gates 812, 813 and 814 are low and gate 815 is high. The first pulse causes flipflop 806 to change state and gate 812 goes high. The next pulse causes gate 813 to go high and the third pulse causes gate 814 to go high. The fourth pulse will cause gate 815 to become high as it was in the beginning of the sequence. Flipflops 806 and 807 control gates 812 through 815 such that only one gate is high at any given instant.

The B counter is similar to the A counter but operates slightly differently as a function of whether the player chooses to play a straight or combination form of the game. If the player chooses to play straight, then each time the A counter receives a pulse from the phase 1 output of flipflop 805, flipflop 801 of the B counter will receive a clock pulse through NAND gate 808 and inverter 809. If the player chooses a combination, then a high is provided from flipflop 102 to NAND gate 816 and each time AND gate 815 goes high, that pulse is gated through inverter 809 to flipflop 810 of the B counter. This causes AND gate 817 to go high, then AND gate 818 to high, then AND gate 819 to go high and finally AND gate 820 to go high in a manner similar to that described for AND gates 812 through 815.

The clock pulses created by oscillator 803 through NAND gates 802 and 804 to flipflop 805 have a frequency twice that of the flipflop since it is a divide by two flipflop and only half as many pulses appear at a given phase output as are applied to the input of the flipflop from oscillator 803. In the combination mode the clock must generate 8 pulses but only 4 will be used to drive the A counter. When AND gate 815 goes high, a pulse is gated through AND 816 and inverter 809 to flipflop 810 of the B counter, causing that counter to change state and one of the AND gates 817 through 820 to go high while the remaining three remain low. Thus only one of the B counter gates will be high at any one time.

Figure 9:
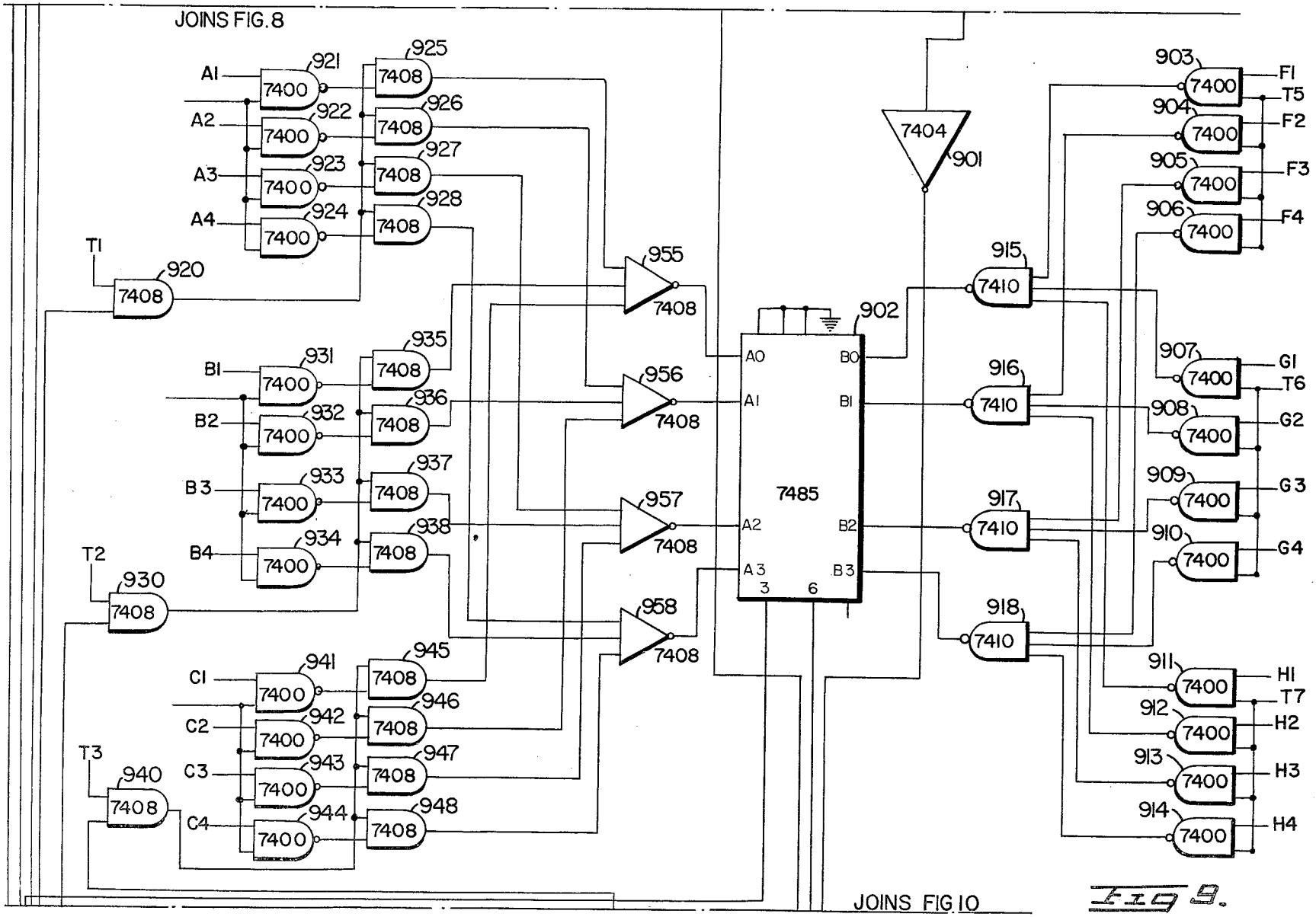
Figure 10:
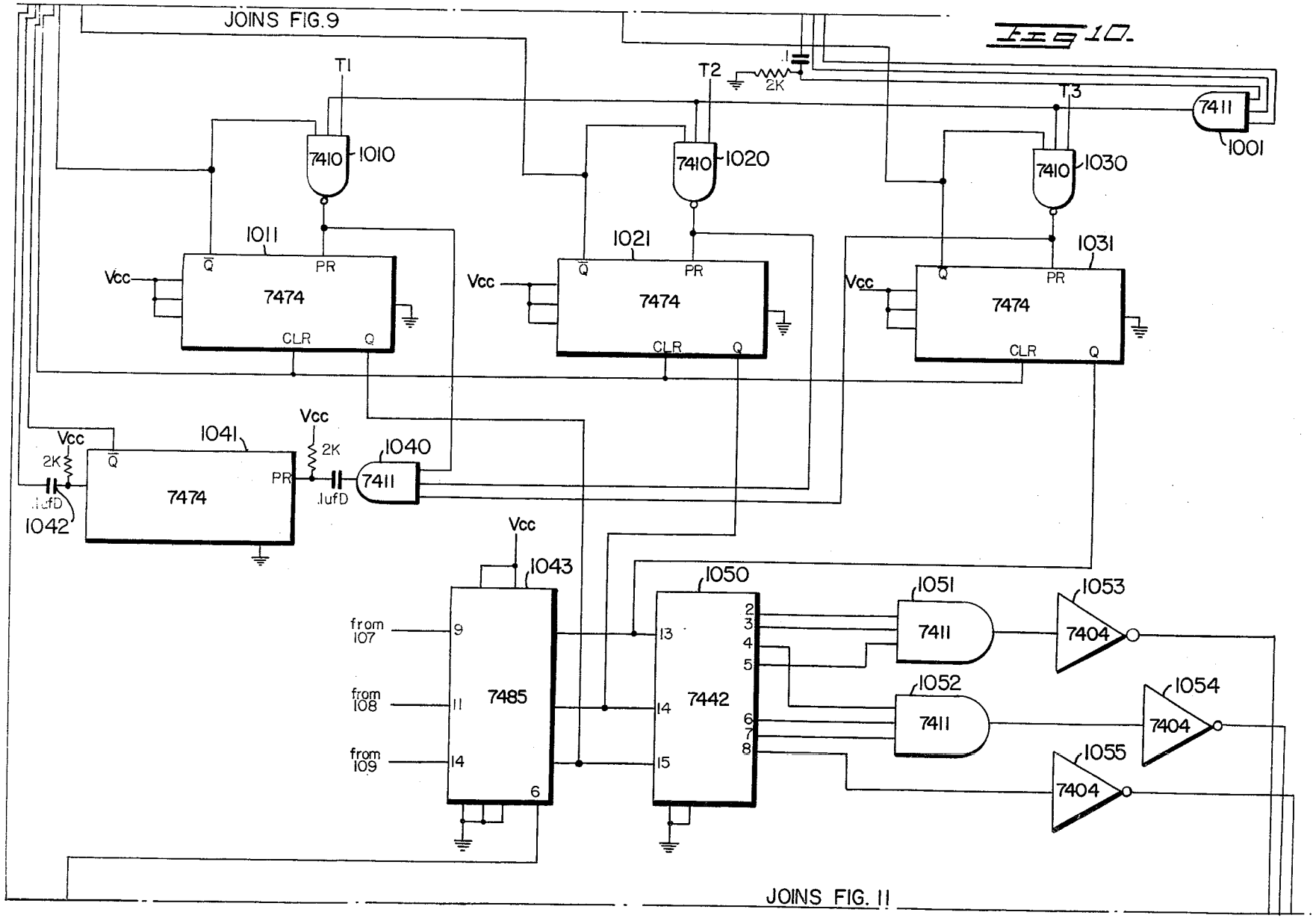

The second output of flipflop 805 (the Q output) is applied to AND gate 1001 of FIG. 10. This AND gate is enabled by inverter 901 of FIG. 9 when AND gate 815 is low and by a high output at pin 6 of comparator 902. Thus when AND gate 815 is low and pin 6 of comparator 902 is high, AND gate 1001 will be enabled when the Q output of flipflop 805 goes high. AND gate 1001 is connected to NAND gates 1010, 1020 and 1030 which gate the outputs of AND gates 812, 813 and 814 respectively to flipflops 1011, 1021 and 1031 respectively. Each NAND gate, 1010, 1020 and 1030 is enabled by the $\overline{Q}$ output from its associated flipflop so that when a comparison is made which causes pin 6 of comparator 902 to go low and generate a high at the output of AND gate 101, the associated flipflop will be set if the respective NAND gate 812 is high. Thus if AND gate 812 is high and a comparison is made, flipflop 1011 will be set, if AND gate 813 is high and a comparison is made, flipflop 1021 will be set and if AND gate 814 is high and a comparison is made, flipflop 1031 will be set. Once flipflop 1011, 1021, or 1031 is set, the $\overline{Q}$ will inhibit the respective NAND gate.

The set pulses from NAND gate 1010, 1020 and 1030 are applied to AND gate 1040 which, when trued sets compare inhibit flipflop 1041. The Q output of compare inhibit flipflop 1041 is coupled to pin 3 of comparator 902. This inhibits the comparator until compare inhibit flipflop 1041 has been reset via capacitor 1042 with a pulse from inverter 809 applied through inverter 821. Thus the comparator is inhibited during a combination play in which the selected digits could have two numbers identical so that they would each compare with numbers from random digit gates.

For instance, suppose the selected numbers were 5, 5 and 6 and the random numbers generated were 5, 0 and 6. When AND gate 817 goes high, enabling the selected digit gates which gate the binary 5 into the comparator and the random digit gates which gate a binary 5 into the comparator, the comparator will produce a low at pin 6 which is reflected as a high at the output of AND gate 1001. The output of AND gate 1001 will set flipflop 1011 because AND gate 812 is high. The pulse that sets flipflop 1011 with set compare inhibit flipflop 1041 and its output will inhibit the comparator. When AND gate 813 goes high, the second digit, which is a 5, is gated into the comparator and an attempt to compare with the 5 from the first random digit gates is made. However, the comparator is inhibited by the input to pin 3 from flipflop 1041 and it will remain inhibited until the A counter has cycled through AND gates 812 through 815. When AND gate 815 goes high, its output is coupled through inverter 809 and inverter 821 to reset flipflop 1041. The output of inverter 809 also steps the B counter to cause AND gate 817 to go low and AND gate 818 to go high.

The random digit gates 903 through 914 of FIG. 9 each have two inputs. The first four random digit gates, 903 through 906 are enabled by a high output from AND gate 817 and couple the BCD code output of decade counter 402 to the comparator via NAND gates 915, 916, 917 and 918.

The random digit generated in decade counter 412 is coupled to comparator 902 via NAND gates 915 through 918 by NAND gates 907 through 910 when those four gates are enabled by AND 818.

The third digit from random digit generator decade counter 423 is coupled to comparator 902 by NAND gates 911 through 914 when AND gate 819 is enabled.

The selected digit gates of the comparator circuitry are arranged in three groups. The first group is comprised of NAND gates 921, 922, 923 and 924 which are configured to function as inverters to couple the BCD coded output of register 205 to AND gates 925, 926, 927 and 928. AND gates 925 through 928 are enabled by AND gate 920 which is trued by an output from AND gate 812 and the $\overline{Q}$ output of flipflop 1011. The BCD digit output of AND gates 925 through 928 is applied to comparator 902 through OR gates 955, 956, 957 and 958.

The second selected digit from register 215 is coupled to comparator 902 via NAND gate inverters 931 through 934 and AND gates 935 through 938 through inverters 955 through 958 providing AND gates 935 through 938 are enabled by AND gate 930 which is trued by an output from AND gate 813 and the $\overline{Q}$ output of flipflop 1021. The third selected digit from register 225 is coupled to comparator 902 via NAND gate inverters 941 through 944, AND gates 945 through 948 and inverters 955 through 958 providing AND gates 945 through 948 are enabled by AND 940. AND gate 940 is enabled by an output from AND gate 814 and the $\overline{Q}$ output of flipflop 1031.

When a selected digit corresponds with a random digit in the comparator 902, the comparators output goes high at pin 6. If no comparison is made pin 6 remains low. The output of pin 6 of comparator 902 is connected to AND gate 1001 as previously discussed. Assuming that the situation is such that AND gate 812 is high, AND gate 815 must then be low. AND gate 815 is connected via inverter 901 to AND gate 1001 so that that input to the gate is also high. With all three inputs to AND gate 1001 high, a high is applied to NAND gate 1010 to coincide with the high applied to that NAND gate by AND gate 812. NAND gate 1010 will go low and set flipflop 1011. The low output of NAND gate 1010 is also applied to AND gate 1040 and it creates a low output from that AND gate which sets compare inhibit flipflop 1041 which provides an inhibit signal to pin 3 of comparator 902.

If the player has chosen a straight for a win, the next pulse from the phase 1 output of flipflop 805 would be applied to the A clock and through NAND 808 to the B clock. The flipflops of the A and B clocks would change states and NAND gate 812 would go low. NAND gate 813 would be high, and in the B clock NAND gate 817 would go low with NAND gate 818 going high. A low level would also appear at the output of inverter 821 to reset flipflop 1041.

With the outputs of AND gates 813 and 818 high, the second sets of gates 931 through 934 and 907 through 910 are enabled. The second digit of the selected digits and the second digit of the random digit appear at the inputs to comparator 902. Assuming that both digits are the same, pin 6 of comparator 902 goes high thus AND gate 1001 has a high input from the comparator and from inverter 901. The next clock pulse from flipflop 805 is a high Q output. This is the third input to AND gate 1001 and a high is thus applied to NAND gates 1010, 1020 and 1030. Of the three NAND gates, only 1020 is enabled via the input from AND gate 813. A low appears at the output of NAND gate 1020 to set flipflop 1021 and compare inhibitor flipflop 1040. The next clock pulse from flipflop 805 is connected to the A and B counters and the pulse coupled to the B counter is inverted by inverter 821 to reset the inhibit flipflop 1041.

The third sets of gates, 941 through 944 and 911 through 914 are now enabled by a high appearing at the output of AND gates 814 and 819. Assuming that the numbers are not the same, the output of comparator 902 at pin 6 will remain low and when the next pulse from flipflop 805 is generated, inverter 821's output is high and the comparator 902 is enabled. The low at pin 6 of comparator 902 does not cause coincidence at AND gate 1001 and its output remains low. AND gate 814 has enabled NAND 1030 but the absence of a high at the output of AND gate 1001 prevents that NAND gate from setting its associated flipflop 1031.

If the player chose a combination for a win, the input to NAND gate 808 from flipflop 101 would be low and the input to NAND 816 from flipflop 102 would be high. At the start of comparison, AND gate 815 would have been high as would AND gate 820. The first clock pulse generated by flipflop 805 would be applied only to flipflop 806, changing the state of AND gate 815 from high to low and AND gate 812 from low to high. When 815 changes to low, its output is coupled via AND gate 816 and inverter 809 to the B counter flipflop 810. This causes AND gate 820 to go low and AND gate 817 to go high. With AND gates 812 and 817 high, the first digit comparison NAND gates 921 through 924 and NAND gates 903 through 906 are enabled. The first digit of the selected digit and the first digit of the random digit will be compared in comparator 902 and if there is no comparison the output at pin 6 of 902 will remain low. The next pulse from flipflop 805 is the Q output and it will enable AND gate 1001. This output remains low until the flipflop is changed by a pulse from NAND gate 804. When this occurs an output is generated at $\overline{Q}$ of flipflop 805 and applied to the A counter. AND gate 812 would be caused to go low and AND gate 813 becomes high. There would be no change in AND gate 817 because the B counter is not incremented. The next clock pulse would again cause a change in state of flipflop 805 and the A counter so that AND gate 813 would become low and AND gate 814 would become high while AND gate 817 remained high. So the first set, then the second set and finally the third set of selected digit gates to the comparator 902 have been enabled while the first random number was held available for comparison.

Assuming that the third selected digit compared with the first random digit, the output of comparator 902 at pin 6 would go high and AND gate 1001 would be enabled. The resultant high output of AND gate 1001 would be applied to NAND gates 1010, 1020 and 1030. However, the only NAND gate which would conduct would be NAND gate 1030 for it would be enabled by the high output of AND gate 814. Thus flipflop 1031 would be set and inhibit flipflop 1041 would be set and reset. The next clock pulse from flipflop 805 would cause AND gate 814 to go low and AND gate 815 to go high. This would disable AND gate 1001 and prevent any spurious pulses from setting one of the compare memory flipflops 1011, 1021 or 1031.

The next pulse out of flipflop 805 to the A counter would cause AND gate 815 to go low and AND gate 812 to go high, also, one pulse would be fed to the B counter causing AND gate 817 to go low and 816 to go high. A sequence is now repeated which is similar to the previously discussed sequence with the exception that all three selected digits are now compared to the second random generator digit. Assuming a comparison is made between the randomly selected digit and the first selected digit, compare memory flipflop 1011 will be set and the A and B counters recycled to enable AND gate 819 so that the third randomly selected digit can be compared with the selected digits.

When the third comparison is made, the first and third selected digit inputs to comparator 902 are inhibited by AND gates 920 and 940 as the result of flipflops 1011 and 1031 being set by the earlier achieved comparisons. Thus during the third cycle only the second selected digit can be compared with the randomly selected digit.

After all the comparisons have been made, the next clock pulse will cause AND gate 820 to go high. Its output is coupled to inverter 822 which creates a low to reset flipflop 801 to stop operation of the comparator by disabling NAND gate 802. The outputs of comparator memory flipflops 1011, 1021 and 1031 are applied to WIN comparator 1043 and coin gate counter 1050.

Figure 11:
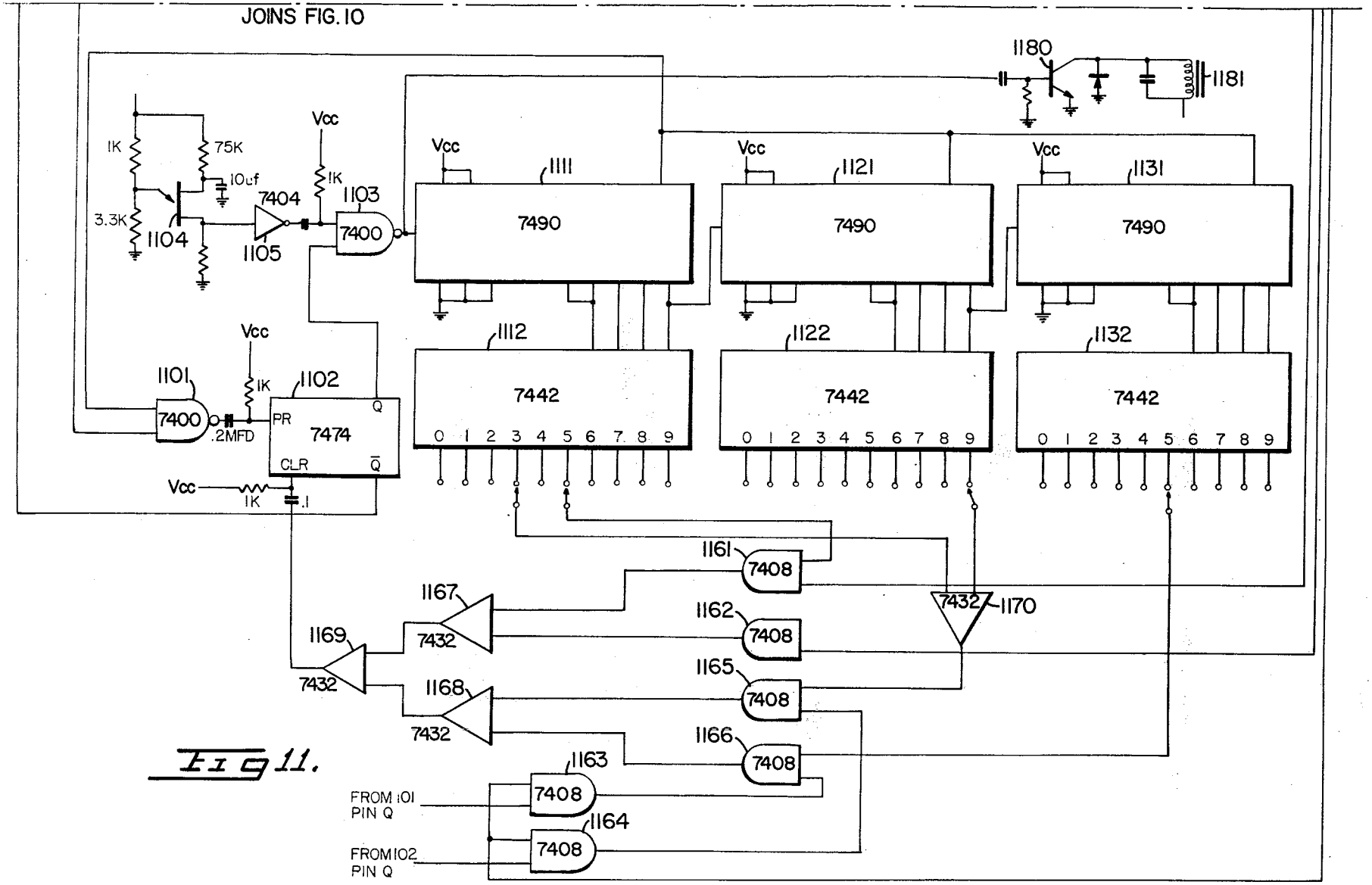

The WIN comparator compares the outputs of compare memory flipflops 1011, 1021 and 1031 to the outputs of AND gates 107, 108 and 109 respectively. These latter inputs to the comparator determine how many digits the player chose to play, one, two or three, and in which arrangement. Each of the inputs to pins 9, 11 and 14 of comparator 1043 indicate which digit a player has played. And the other three inputs indicate how many comparisons were made. When a coincidence is achieved between the number of inputs from gates 107, 108 and 109 with the number of inputs from flipflops 1011, 1021 and 1031, pin 6 becomes high and NAND gate 1101 which is enabled by outputs from decade counters 1111, 1121 or 1131 sets flipflop 1102. When flipflop 1102 is set, its Q output goes high and enables NAND gate 1103 of FIG. 11.

Unijunction transistor 1104 in combination with the associated RC components form an oscillator that generates about 1.5 pulses per second. This pulse train is coupled to NAND gate 1103 by inverter 1105. When NAND gate 1103 is enabled by flipflop 1102, the pulses coupled through inverter 1105 are applied to decade counter 1111. The output from decade counter 1111 is fed to decade counter 1121 which in turn applies pulses to decade counter 1131. The binary count which appears in each counter is also applied to an associated decade decoder 1112, 1122 or 1132.

The outputs of compare memory flipflops 1011, 1021 and 1031 are considered BCD numbers by coin gate 1050. Coin gate 1050 interprets the BCD number by decoding it, for instance if pin 15 is high and pins 14 and 13 are low, output pin 2 is low and all the other output pins are high. If pin 14 is high and the other two input pins are low, pin 3 would be low and the rest of the output pins would be high. If pin 13 is high and the other two input pins are low, pin 4 would also be low and the remaining output pins would be high. If a player chooses two numbers, then two of these input lines would be high if the numbers made a comparison. Assuming a player chooses two numbers to play and only the second digit compared, flipflop 1021 would provide a high output to pin 14 of coin gate 1050. Pins 13 and 14 of coin gate 1050 would be low and pin 3 of the output would be low.

The outputs of coin gate 1050 are applied to AND gates 1051 and 1052. AND gate 1051 is configured to decode a single number win and AND gate 1052 is configured to decode a two number win. Pin 8 is utilized for three number wins. The outputs of AND gates 1051, 1052 and pin 8 of coin counter 1050 are applied through inverters 1053, 1054 and 1055 respectively to the coin dispenser logic.

The coin dispenser circuitry is initiated when NAND gate 1101 is trued to cause counters 1111, 1121 and 1131 to begin accumulating pulses. This only occurs if there is a win and pin 6 of WIN comparator 1043 goes low as previously explained. The coin gate 1050 decodes the number of comparisons and the resultant is provided as outputs at inverters 1053, 1054 and 1055. The inverter outputs are applied to AND gates 1161, 1162, 1163 and 1164 which, in combination with AND gates 1165 and 1166 and an OR gate comprised of two-input OR gates or inverting amplifiers 1167, 1168 and 1169 are used to decode the total number of checks to be dispensed by the coin dispenser. A decimal output from decoders 1112, 1122 and 1132 is combined in the AND gates with the outputs of inverters 1053, 1054 and 1055. For instance, if a player chose to play one number and it was a win, AND gate 1051 would produce an output through inverter 1053. The output of inverter 1053 would be applied to one input of AND gate 1161. A high from pin 6 of WIN comparator 1042 would set flipflop 1102 via NAND gate 1101 and enable the counter via NAND gate 1103 and start the check dispenser by pulsing the base of transistor 1180. Each time transistor 1180 is pulsed, solenoid coil 1181 is energized and causes a coin to be dispensed. Thus a coin is dispensed once every one and a half seconds. As coins are being dispensed, the number of pulses causing the solenoid action are being counted in counters 1111, 1121 and 1131. As the counters are being incremented, the decoders 1112, 1122 and 1132 are registering the count by switching their outputs numbered 0 through 9 from lows to highs. Thus in the exemplary case with AND gate 1161 enabled by inverter 1053, five pulses would be produced at NAND gate 1103 causing five checks to be dispensed and the outputs 0 through 5 of decoder 1112 to be stepped from low to high. When output 5 of decoder 1112 is stepped too high, AND gate 1161 is trued and a pulse is applied through OR gates 1167 and 1169 to reset flipflop 1102. Resetting flipflop 1102 inhibits NAND gate 1103 to stop the counter and halt check deliveries.

An OR gate 1170 is included in the circuit to couple counter outputs to AND gate 1165.

The actual coin dispensing mechanism energized by transistor 1180 is not presented here for any of the many commercially available electrical coin dispensers may be driven by this circuit.

The coin counter displays 610, 620, 630 and 640 are light emitting diode displays capable of registering a total of $99.75. When a new play has been started, by the insertion of a check to close switch 701, the coin counter is reset, LED 610 and LED 620 will be blank and LED 630 will display a 2 and LED 640 will display a 5. As coins are inserted into the machine, switch 701 is repeatedly closed causing pulses to be applied to flipflop 641 and 631, causing the flipflops to change state. Each time flipflop 641 changes state, the indication by light emitting diode 640 changes from 0 to 5 to 0 etc. Flipflops 631 and 632 form a four digit counter which applies pulses to BCD decoder 633 in a manner which causes it to count 0, 2, 5, 7, 0. The outputs from decade counter 633 are applied to light emitting diode 630 so that in combination, light emitting diodes 630 and 640 will register 0.25, 0.50 and 0.75. The decimal point is always present at the beginning of light emitting display 630 as a function of the potential applied through resistor 634.

When the counter comprised of flipflops 631 and 632 reaches 4, an output at Q of flipflop 632 is applied to decade counter 621. The decade counter applies pulses to BCD decoder 613 which drives the seven segment LED display 620. When decade counter 621 has cycled through 9, it steps decade counter 611. Decade counter 611 is similar to decade counter 621 and it sequences BCD decoder 613 to cause digits to be displayed in the seven segment LED display 613.

Counters 611, 621, 632, 631 and 641 are reset when a game initially begins as indicated by an output from AND gate 103 as applied to capacitor 601 and inverters 602 and 603.

Figure 7:
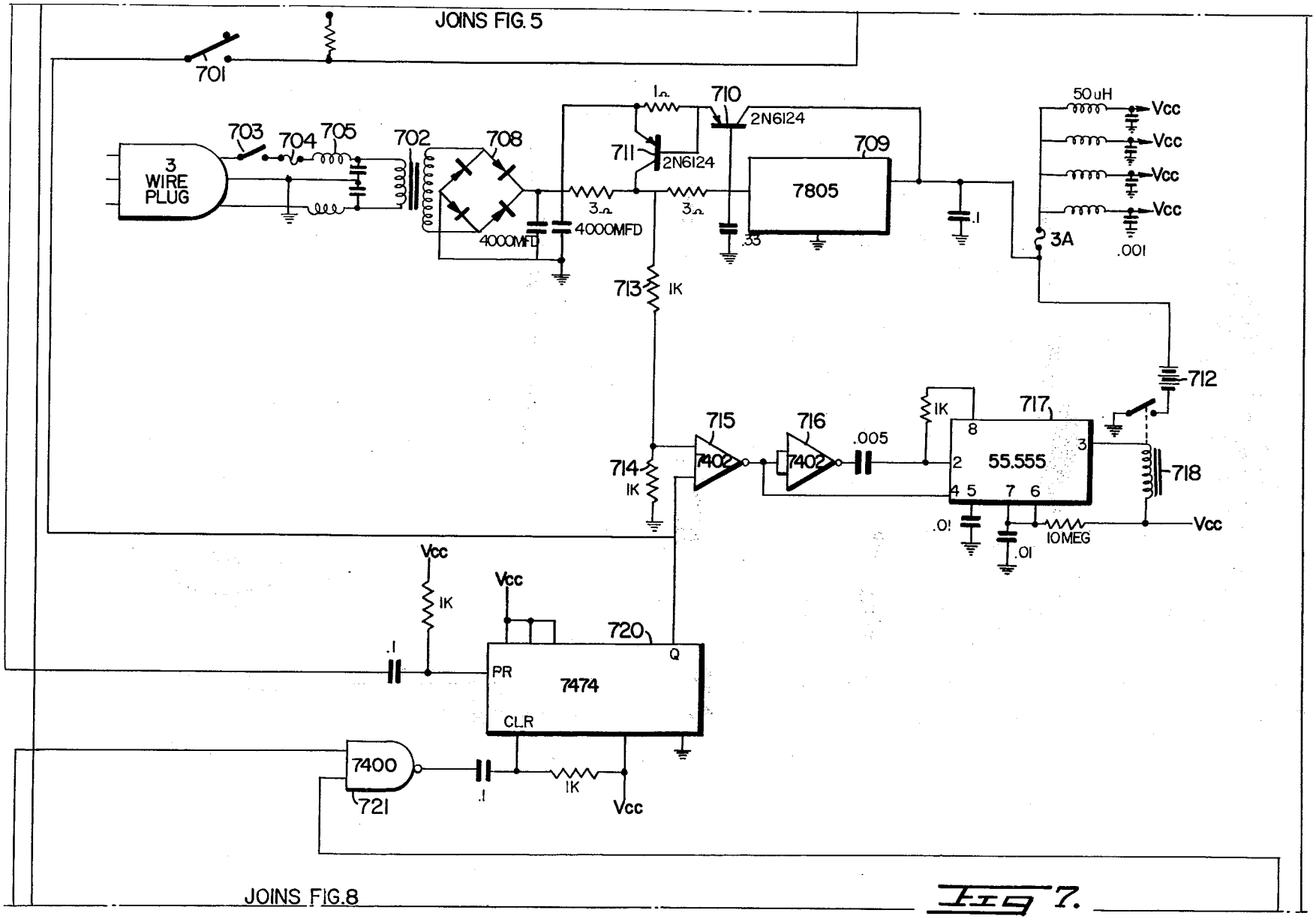

The power supply incorporated in the circuitry is illustrated in FIG. 7. It is a conventional transistorized power supply with RF filtering coupling a three wire plug to a transformer 702. Power from the three wire plug to transformer 702 is controlled by switch 703 and fuse 704 and RC filtering is provided by the LC components between the plug and transformer 702. These components include two 0.5 MH bifilar wound choke coils 705 and 706.

The secondary of transformer 702 is coupled to a full wave bridge rectifier 708 that is adapted to provide a DC potential to regulator 709 which produces a regulated 5 volt DC output. Transistors 710 and 711 are provided to increase the output current to meet the demands of the circuitry of the total system.

To keep sporadic abnormalities from the 10 volt power source from upsetting the circuitry of the system, 4 nickel cadmium batteries 712 are coupled to the output circuit so that they will become active in the event of a power lapse.

The emergency power is provided by supplying voltage from the power supply output to a voltage divider comprised of resistors 713 and 714 and to an input of NOR gate 715. The output of NOR gate 715 is normally low and the output of inverter 716 is high. The output of inverter 716 is applied to timer 717 which controls current application to the coil of relay 718. The single set of contacts in relay 718 is adapted to ground the nickel cadmium batteries 712 and provide current from that source to the machine in the event of a power failure.

Flipflop 720 produces an output which is coupled to NOR gate 715 and to coin switch 701. Normally the output of flipflop 720 at Q is low so switch 703 can reset the circuitry for the first coin deposited and pulse the coin counter. Once the straight or combination flipflop 101 or 102 is selected, their output is connected to NAND gate 103 which drives inverter 104 which sets flipflop 720 to cause the flipflops output to go high at Q. This disables the coin switch from operating and also enables NOR gate 715 so that if a power failure occurs, the nicad battery supply 712 will provide current required by the machine to complete the game.

Once play has started, after the random digit generator has generated its numbers and the compare circuitry and logic has completed their cycle and a WIN did not occur, flipflop 1102 $\overline{Q}$ output will be high and upon completion of the A and B counters, the output from AND gate 820 goes high. This causes the output of NAND gate 721 to go low and reset flipflop 720.

In the event of a power failure, both inputs to NOR gate 715 are low and its output will be high. This causes the output of inverter 716 to go low and trigger timer 717. After approximately 45 seconds, timer 717 causes relay 718 to deenergize, turning off the machine. If there had been a win, the $\overline{Q}$ output of flipflop 1102 would have been low and would have waited until the proper amount of coins were dispensed by the machine, then its output would go high. AND gate 820 would be high and would have reset flipflop 720.

Both inputs have to be high before the machine will turn off. Each time the compare logic completes a cycle or a play, both inputs to NAND gate 721 will be high so that the output of flipflop 720 will be low. This will reenable the coin switch and if the machine was to be turned off on purpose, the input to inverter 716 would be low which would trigger timer 717. After about 45 seconds, the relay would open.

For a new play, the first check that is inserted into the machine causes a reset pulse to be applied to flipflop 805 and flipflops 806 and 807 of the A counter and 810 and 811 of the B counter to ensure that they are in the proper state. Also, the mode control counter flipflops 505 and 506 and flipflops 101 and 102 are reset each time a coin is inserted and pulses are fed to the coin counters.

Counters 611, 621, 632, 631 and 641 are reset one time only by AND gate 103 as the result of flipflops 101 or 102 being reset. The reset pulses are coupled into counters 631 and 641 to clock each flipflop.

While a preferred embodiment of this invention has been illustrated and described, variations and modifications may be apparent to those skilled in the art. Therefore, I do not wish to be limited thereto and ask that the scope and breadth of this invention be determined from the claims which follow rather than the above description.

What I claim is:

1. A number comparison game, comprising:

number selection means for generating an electronic representation of a selected number;

random number generator means for generating an electronic representation of a random number;

a comparator for comparing the electronic representation created by said number selection means with the electronic representation created by said random number generator means;

a digital keyboard for generating binary coded digital pulses in response to key depression;

a plurality of selected number counters responsive to said keyboard for providing binary coded digital pulses;

a plurality of selected number decoders responsive to said selected number counters;

a plurality of seven segment illuminated digit displays responsive to said selected number decoders;

a direct comparison flipflop responsive to said keyboard; and a partial comparison flipflop responsive to said keyboard; and said random number generator comprises:

a random number generator flipflop responsive to said direct comparison and said partial comparison flipflops;

a first random number generator oscillator responsive to said random number generator flipflop;

a counter responsive to said first random number generator oscillator;

a second random number generator oscillator;

a third random number generator oscillator responsive to said second random number generator oscillator;

a plurality of AND gates responsive to outputs from said counter and said random number generator third oscillator;

a plurality of random number generator digit counters responsive to said AND gates;

said random number generator digit counters providing binary coded digital pulse signals in response to inputs from said AND gates;

a plurality of random number generator digit decoders responsive to said binary coded digital pulse signals; and a plurality of seven segment illuminated digit indicators responsive to said random number generator digit decoders; and said comparator comprises:

a comparator flipflop responsive to said direct comparison and said partial comparison flipflops;

a comparator oscillator responsive to said comparator flipflop;

comparison selection means responsive to said comparator oscillator and said direct comparison and said partial comparison flipflops;

a first comparison counter responsive to said comparison selection means;

a second comparison counter responsive to said comparison selection means;

a plurality of AND gates responsive to said first comparison counter;

a plurality of AND gates responsive to said second comparison counter;

a plurality of groups of logic gates responsive to said selected digit counters and said AND gates responsive to said first comparator counter;

a second group of logic gates responsive to said random number digit counters and said AND gates responsive to said second comparator counter;

a pulse comparison means for comparing the outputs of said groups of logic gate means with the outputs of said second groups of logic gate means;

a plurality of compare logic gates responsive to said pulse comparator, said comparator oscillator, and one of said AND gates responsive to said first comparator counter;

a plurality of compare storage flipflops responsive to said compare logic gates;

a WIN register responsive to said direct comparison and partial comparison flipflops and said selected number counters;

a WIN flipflop responsive to said WIN register;

a WIN oscillator responsive to said WIN flipflops;

a WIN counter responsive to said WIN oscillator;

a WIN counter register responsive to said WIN counter;

a check dispensing solenoid responsive to said WIN oscillator;

means for receiving checks;

means for counting received checks;

a check dispenser counter responsive to said compare storage flipflops; and logic means responsive to said check dispenser counter and said check counter for resetting said WIN flipflop.

2. A number comparison game, comprising:

a number selection means for generating an electronic representation of a selected number and including digit counters for said selected number;

random number generator means for generating an electronic representation of a random number and including random number digit counters;

a direct comparison flipflop responsive to said number selection means;

a partial comparison flipflop responsive to said number selection means;

a comparator flipflop responsive to said direct comparison and said partial comparison flipflops;

a comparator oscillator responsive to said comparator flipflop;

comparison selection means responsive to said comparator oscillator and said direct comparison and said partial comparison flipflops;

a first comparison counter responsive to said comparison selection means;

a second comparison counter responsive to said comparison selection means;

a plurality of AND gates responsive to said first comparison counter;

a plurality of AND gates responsive to said second comparison counter;

a plurality of groups of logic gates responsive to said selected digit counters and said AND gates responsive to said first comparator counter;

a second group of logic gates responsive to said random number digit counters and said AND gates responsive to said second comparator counter;

a pulse comparison means for comparing the outputs of said groups of logic gate means with the outputs of said second groups of logic gate means;

a plurality of compare logic gates responsive to said pulse comparison means, said comparator oscillator, and one of said AND gates responsive to said first comparison counter; and a plurality of compare storage flipflops responsive to said compare logic gates.

3. A number comparison game as defined in claim 2, comprising:

a WIN register responsive to said number selection means;

a WIN flipflop responsive to said WIN register;

a WIN oscillator responsive to said WIN flipflops;

a WIN counter responsive to said WIN oscillator;

a WIN counter register responsive to said WIN counter;

a check dispensing solenoid responsive to said WIN oscillator;

means for receiving checks;

means for counting received checks;

a check dispenser counter responsive to said compare storage flipflops; and logic means responsive to said check dispenser counter and said check counter for resetting said WIN flipflop.

* * * * *